US010307635B1

(12) United States Patent
Khalil

(10) Patent No.: US 10,307,635 B1
(45) Date of Patent: Jun. 4, 2019

(54) LOW-PROFILE ROLLING EXERCISE DEVICE UNDERLYING AND SUPPORTING USER'S FOOT WHILE DOING BODY EXERCISE

(71) Applicant: Adel Shoukry Khalil, Lake Park, FL (US)

(72) Inventor: Adel Shoukry Khalil, Lake Park, FL (US)

(73) Assignee: Core 500 LLC, Lake Park, FL (US)

( * ) Notice: Subject to any disclaimer, the term of this patent is extended or adjusted under 35 U.S.C. 154(b) by 39 days.

(21) Appl. No.: 15/357,491

(22) Filed: Nov. 21, 2016

Related U.S. Application Data

(63) Continuation-in-part of application No. 14/077,739, filed on Nov. 12, 2013, now Pat. No. 9,533,183.

(51) Int. Cl.

| | |
|---|---|
| ***A63B 22/20*** | (2006.01) |
| ***A63B 21/00*** | (2006.01) |
| ***A63B 21/22*** | (2006.01) |
| ***A63B 23/12*** | (2006.01) |

(52) U.S. Cl.
CPC ..... *A63B 22/20* (2013.01); *A63B 21/0004* (2013.01); *A63B 21/22* (2013.01); *A63B 21/4035* (2015.10); *A63B 21/4043* (2015.10); *A63B 23/12* (2013.01)

(58) Field of Classification Search
CPC . A63B 21/22; A63B 21/0004; A63B 21/4043; A63B 21/4035; A63B 22/20; A63B 23/12
See application file for complete search history.

(56) References Cited

U.S. PATENT DOCUMENTS 8,016,732 B2 * 9/2011 Susnjara ..... A63B 21/0004 482/142
9,623,273 B1 * 4/2017 Chen ..... A63B 21/0004

* cited by examiner

*Primary Examiner* — Megan Anderson
(74) *Attorney, Agent, or Firm* — Glenn E. Gold, P.A.; Glenn E. Gold

(57) ABSTRACT

A rolling exercise device includes a support body having a lower body portion forming four spaced apart recessed corners having respective recesses open from below and around the exterior of the corners, an upper body portion forming four interconnected corner segments overlying the four recessed corners, and a concave cavity recessed in the upper and lower body portions from a top opening defined by a continuous interior rim of the upper body portion to an interior concave bottom wall surface of the lower body portion. The device also includes mounting seats supported in the recesses of the recessed corners and rollers rotatably mounted in the mounting seats and extending below the lower body portion so as to adapt the support body to be freely rolled across a surface supporting the rolling exercise device with at least a portion of a foot of a user extending into the concave cavity.

20 Claims, 11 Drawing Sheets

LOW-PROFILE ROLLING EXERCISE DEVICE UNDERLYING AND SUPPORTING USER'S FOOT WHILE DOING BODY EXERCISE

CROSS REFERENCE(S) TO RELATED APPLICATION(S)

This U.S. non-provisional patent application is a continuation-in-part application which claims the benefit of co-pending U.S. non-provisional patent application Ser. No. 14/077,739, filed Nov. 12, 2013, which is hereby incorporated in its entirety herein by reference thereto.

FIELD OF THE INVENTION

The present invention generally relates to exercise devices and, more particularly, is concerned with a rolling exercise device having a modular construction with a low profile for underlying and supporting a foot of a user in order to support at least a portion of the user's weight while doing body exercises using the device on a supporting surface.

BACKGROUND OF THE INVENTION

Many exercise devices are known in the prior art. There are specific ones designed to assist users in performance of upper body exercises on support surfaces, such as a floor. These devices have several different designs.

One prior art design, disclosed in U.S. Pat. No. 6,773,379, U.S. Pat. App. Pub. No. 2012/0238420, and U.S. Des. Pat. Nos. D653,714, D654,544 and D666,684, employs a solid base, a plurality of rollers, balls or wheels rotatably mounted to and extending below a bottom side of the solid base so as to movably support the base on the support surface, and a handle affixed on and extending above an upper side of the solid base such that the gripping portion of the handle is spaced above the solid base where it can be gripped by a user to guide the movable base across the support surface. One potential drawback of this design might be that the weight of the solid base could be excessive such that it tends to increase the resistance or drag of the device thus impeding it from moving freely across the support surface. Another potential drawback might be the height of the handle above the floor could be excessive due to its mounting arrangement which necessarily spaces it above the solid base in order to allow for insertion of fingers about the handle in order to grip it. The excessive height of the handle might cause tilting of the device from skewing or bias the force applied by the user more toward one set of the balls, rollers or wheels than the other during performance of exercises so as to further increase the resistance or drag of the device to moving freely across the surface.

Another prior art design disclosed in U.S. Pat. No. 3,809,393 employs separate plate-like support members at opposite ends of a handle that are in turn supported by swivel casters. The provision of separate support members might reduce at least a portion of the excessive weight of a solid base as used in the prior art design discussed above. However, the employment of swivel casters might be a potential drawback that offsets the benefit from any weight savings in that the swivel casters might increase the resistance or drag of the device to moving freely across the surface. Also, another potential drawback might be the techniques of construction utilized in making the device of the cited patent. In one embodiment, the opposite end portions of the handle are rabbeted or notched in order to form joints between the handle and the separate support members. In the other embodiment, bores that receive the opposite end portions of the handle are formed completely through the middle of the separate support members in order to form joints between the handle and separate support members. These techniques of construction might result in weakening the structural integrity of either the handle or support members when the device is called on to support the upper body weight of the user during use of the device.

In addition to the aforementioned drawbacks, these prior art exercise devices have handles intending them for hand use. Accordingly, there remains a need for an innovation that will overcome these potential drawbacks of the known prior art and any problems that remain unsolved.

SUMMARY OF THE INVENTION

The present invention is directed to an innovation that overcomes the potential drawbacks of the known prior art and any problems that remain unsolved by providing a rolling exercise device having a modular construction and with a low profile relative to a surface supporting the device. The modular construction of the rolling exercise device reduces its overall height and weight, facilitates ease of manufacture and assembly of the device, and augments its structural integrity during use. The low profile of the rolling exercise device together with its reduced height and weight and augmented structural integrity enhance its stability in supporting at least a portion of the weight of a user and minimize its resistance or drag, and thus maximize its glide capability such that as a foot of the user is underlain and supported by the device the user is enabled to perform exercises using upper body muscles as the device moves more freely in any direction on the supporting surface.

In one aspect of the present invention, a rolling exercise device includes:

- a support body having
  - a lower body portion forming at least four recessed corners spaced apart from one another and having respective recesses open from below and around the exterior of the at least four recessed corners,
  - an upper body portion forming at least four corner segments interconnected to one another and overlying the at least four recessed corners of the lower body portion, and
  - a cavity recessed in the upper and lower body portions and extending from a top opening defined by a continuous interior rim of said upper body portion to and including an interior concave bottom wall surface of the lower body portion;
- a plurality of mounting seats each being supported in a respective one of the recesses of the at least four recessed corners of the lower body portion of the support body; and
- a plurality of rollers each being rotatably mounted in a respective one of the mounting seats and extending below the lower body portion of the support body so as to adapt the support body to be freely rolled by the rollers across a surface supporting the rolling exercise device with at least a portion of a foot of a user extending into the cavity of the support body to support at least a portion of the body weight of the user on the rolling exercise device as the user performs exercises on the surface.

In another aspect of the present invention, a rolling exercise device includes:

- a support body having a lower body portion forming a square cross having a central segment and four radial leg segments terminating at exterior end surfaces, and four recessed corners spaced apart from one another and having respective recesses formed by the central segment and the four radial leg segments of the square cross and being open from below and around the exterior of the four recessed corners, an upper body portion forming a square platform having four corner segments interconnected to one another and overlying the four recessed corners of the lower body portion, and a continuous exterior sidewall extending about the four corner segments and merging with the exterior end surfaces of the four radial leg segments of the lower body portion, and a concave cavity formed in the upper and lower body portions and having a top opening defined by a continuous interior top surface proximate a continuous interior rim of the square platform of the upper body portion, an interior concave bottom wall surface defined in the central segment of the square cross of the lower body portion, and a continuous interior sidewall surface extending in the upper and lower body portions so as to interconnect the continuous interior rim of the upper body portion and the interior concave bottom wall surface of the lower body portion;

a plurality of mounting seats each being supported in a respective one of the recesses of the four recessed corners of the lower body portion of the support body; and a plurality of rollers each being rotatably mounted in a respective one of the mounting seats and extending below the square cross of the lower body portion of the support body so as to adapt the support body to be freely rolled by the rollers across a surface supporting the rolling exercise device with at least a portion of a foot of a user extending into the cavity of the support body to support at least a portion of the body weight of the user on the rolling exercise device as the user performs exercises on the surface.

In still another aspect of the present invention, a rolling exercise device includes:

a support body having a lower body portion forming a square cross having a central segment and four radial leg segments terminating at exterior end surfaces, and four recessed corners having respective recesses formed by the central segment and four radial leg segments of the square cross and being open from below and around the exterior of the four recessed corners, an upper body portion forming a square platform having four corner segments interconnected to one another and overlying the four recessed corners of the lower body portion, and a continuous exterior sidewall extending about the four corner segments and merging with the exterior end surfaces of the four radial leg segments of the lower body portion, and a concave cavity formed in the upper and lower body portions and having a top opening defined by a continuous interior top surface proximate a continuous interior rim of the square platform of the upper body portion, an interior concave bottom wall surface defined in the central segment of the square cross of the lower body portion, and a continuous interior sidewall surface extending in the upper and lower body portions so as to interconnect the continuous interior top surface of the upper body portion and the interior concave bottom wall surface of the lower body portion;

a plurality of mounting seats each being supported in a respective one of the recesses of the four recessed corners of the lower body portion of the support body, each of the mounting seats including a socket affixed to and extending below a bottom side of a respective one of the four corner segments of the upper body portion of the support body, the socket being of a hollow configuration and having a cylindrical sidewall with a lower open end and an upper wall across and affixed to an upper end of the cylindrical sidewall, and a sleeve of a spherical configuration with opposite top and bottom truncated ends, the sleeve having an outside diameter matched with an inside diameter of the cylindrical sidewall of the socket such that the sleeve snugly fits, via the lower open end of the socket, into the socket; and a plurality of rollers each being rotatably mounted in a respective one of the sleeves of the mounting seats and extending above and below the top and bottom truncated ends of the respective one of the sleeves and below the square cross of the lower body portion of the support body so as to adapt the support body to be freely rolled by the rollers across a surface supporting the rolling exercise device with at least a portion of a foot of a user extending into the cavity of the support body to support at least a portion of the body weight of the user on the rolling exercise device as the user performs exercises on the surface.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
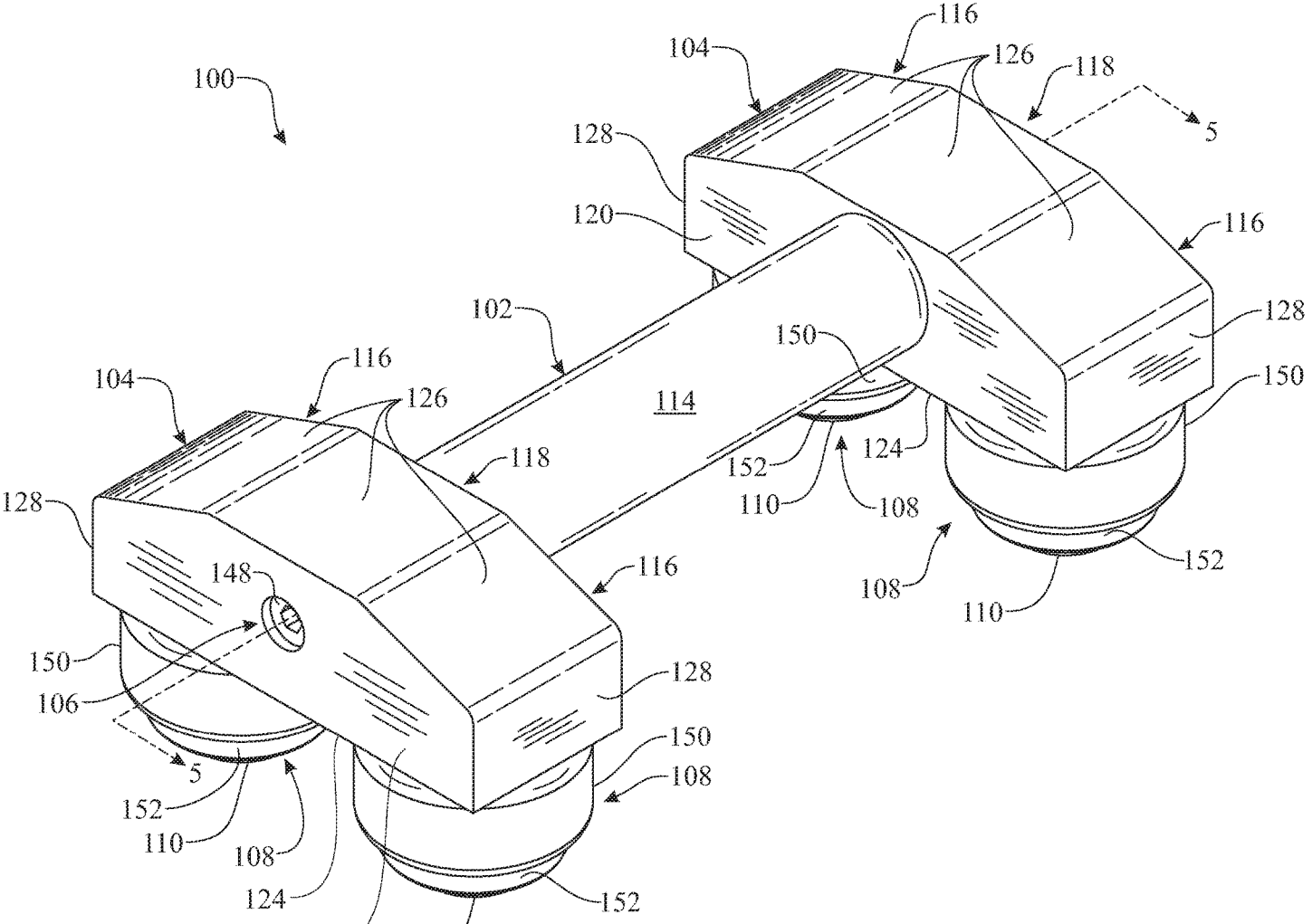
FIG. 1 presents a top isometric view of an exemplary embodiment of a low profile rolling exercise device in accordance with the invention of the patent application cross-referenced above, the view showing the device in a fully assembled form.
Figure 2:
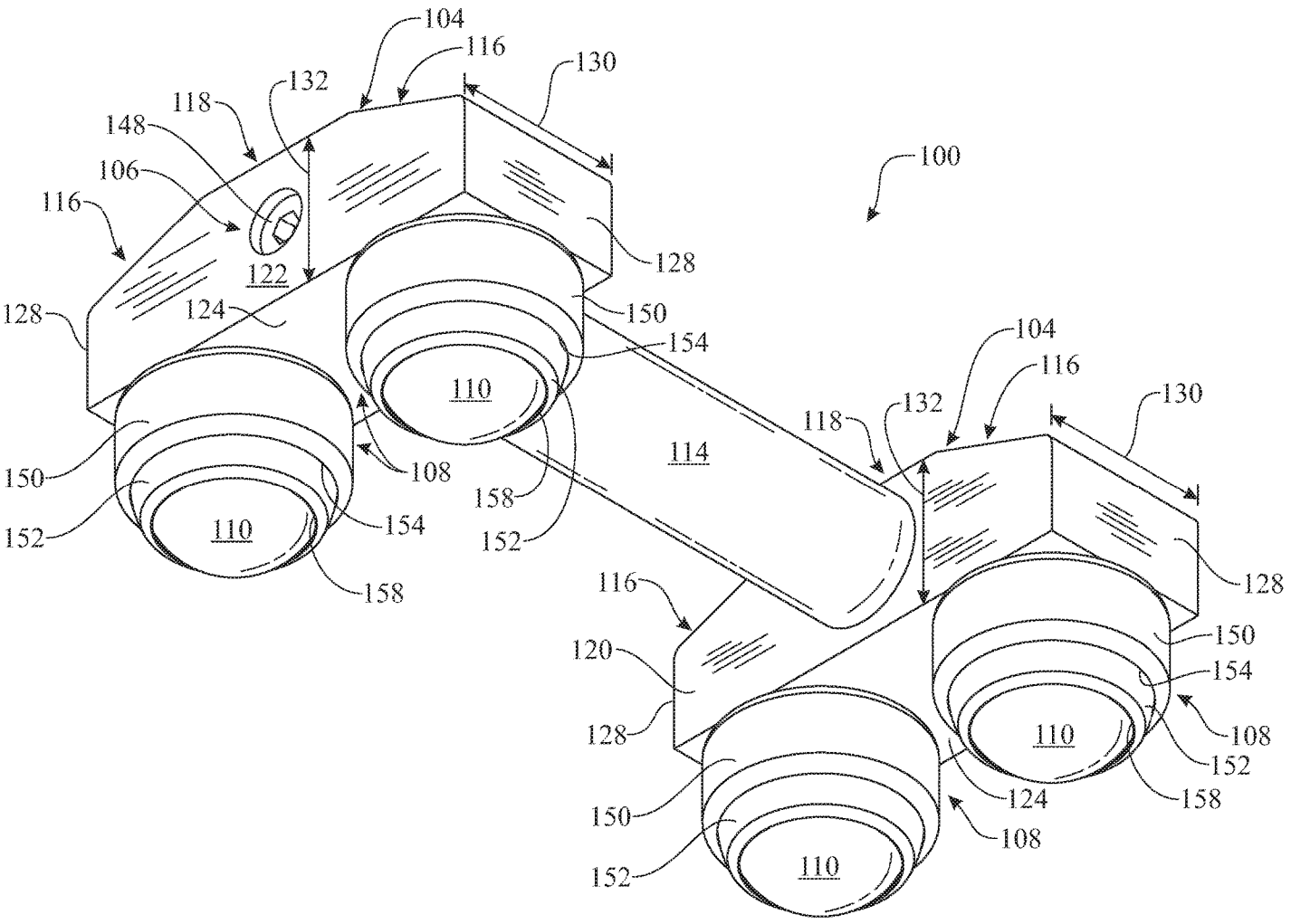
FIG. 2 presents a bottom isometric view of the device originally introduced in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "bottom", "top", "inside", "outside", "end", and derivatives thereof shall relate to the invention as oriented in FIGS. 1 and 2. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-6, there is illustrated an exemplary embodiment of a rolling exercise device, generally designated 100, having a modular construction and a low profile in accordance with the invention of the patent application cross-referenced above. The device 100 basically includes an elongated handle 102, a pair of support bodies 104 each being a single unit separate from, but substantially identical to, one another, and connections 106 securing the support bodies 104 to the opposite ends of the handle 102 in a fixed relationship with respect to each other such that only the elongated handle 102 extends between and interconnects the two single units. Each of the support bodies 104 includes a beam 107 and a pair of mounting seats 108 provided beneath the beam 107 of each of the support bodies 104. Each of the support bodies 104 also includes a pair of rollers 110 rotatably mounted in the mounting seats 108 so as to adapt the support bodies 104 to be freely rolled by the rollers 110 across a support surface or floor as a user gripping the handle 102 supports his or her weight on the handle. A modular construction is provided in the sense that the support bodies 104 are mirror images of each other and thus are interchangeable with one another with respect to their positional relationships at the opposite ends of the handle 102. Furthermore, the beams 107 of the support bodies 104, which may be solid structures, span over and are supported by the mounting seats 108 and rollers 110 of the support bodies 104 so as to provide the overall device 100 with a relatively low profile. The components of the device 100 may be made by application of well-known fabrication techniques using various materials, such as metals or plastics.

As best seen in FIGS. 1-5, the elongated handle 102 has opposite ends 112 and a grip portion 114 extending between and merging with the opposite ends 112. The handle 102 also has a uniform cylindrical cross-sectional configuration from end to end and a longitudinal axis 115 extending lengthwise of the handle 102 through the opposite ends 112 and the grip portion 114. Alternatively, the handle 102 may have other suitable cross-sectional configurations.

Referring again to FIGS. 1-6, each of the support bodies 104 includes opposite end portions 116 and a middle portion 118 extending between and merging into the opposite end portions 116. The opposite end portions 116 are mirror images of, and substantially identical to, one another. Each of the support bodies 104 also includes opposite inner and outer sides 120, 122, opposite bottom and top sides 124, 126, and opposite ends 128. Each of the support bodies 104 further has a width 130 extending between the opposite inner and outer sides 120, 122. The width 130 of each of the support bodies 104 at the middle portion 118 is substantially the same as at the opposite end portions 116. Each of the support bodies 104 also has a height 132 extending between the bottom and top sides 124, 126 that, as can be readily seen in FIG. 6, is at a maximum at the middle portion 118 and decreases by tapering down to a minimum at opposite ends 128 of the support body 104 on the opposite end portions 116.

Figure 3:
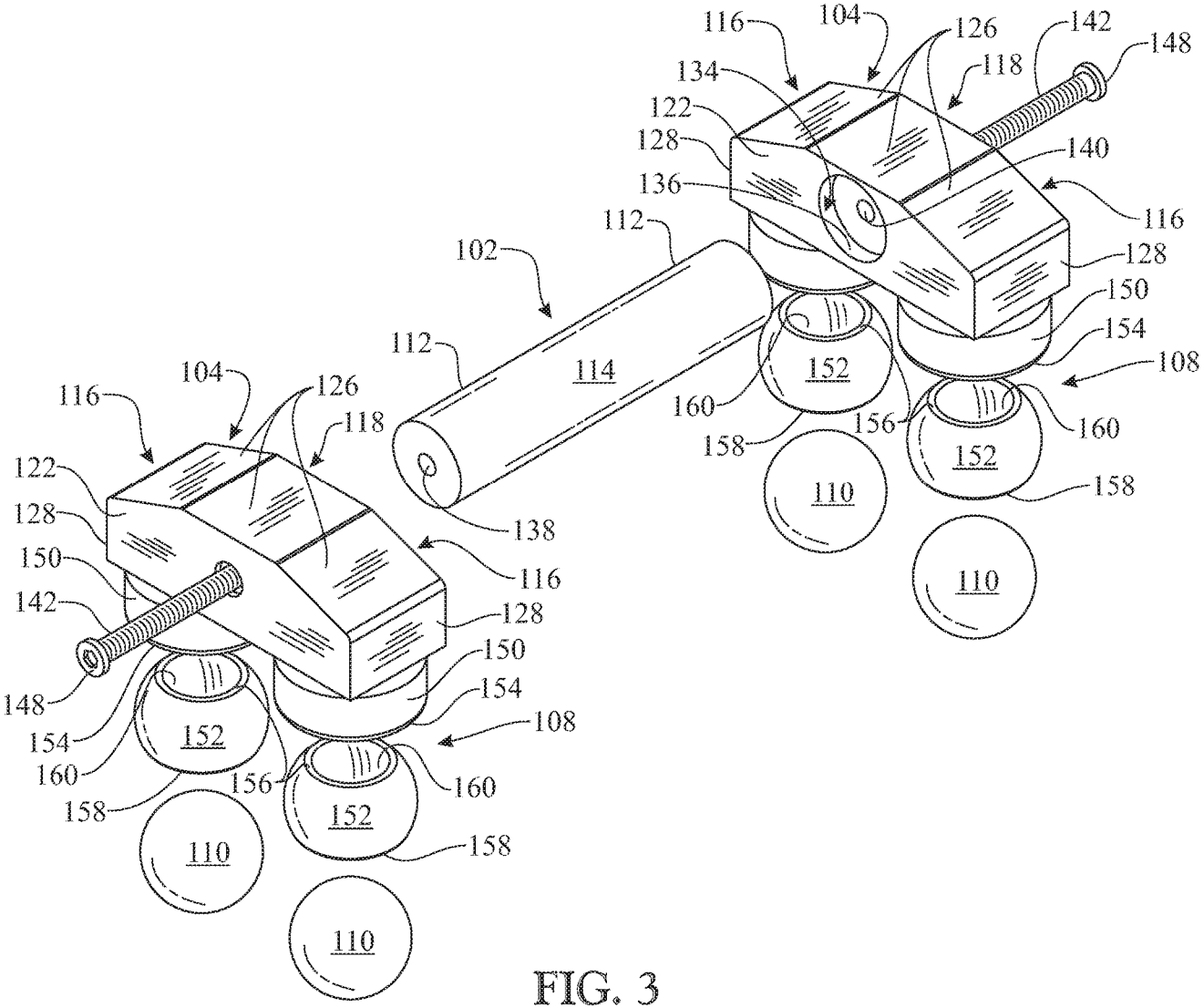
FIG. 3 presents a top isometric view of the device, the view showing the device in an exploded form and on a reduced scale compared to that of FIGS. 1 and 2.
Figure 4:
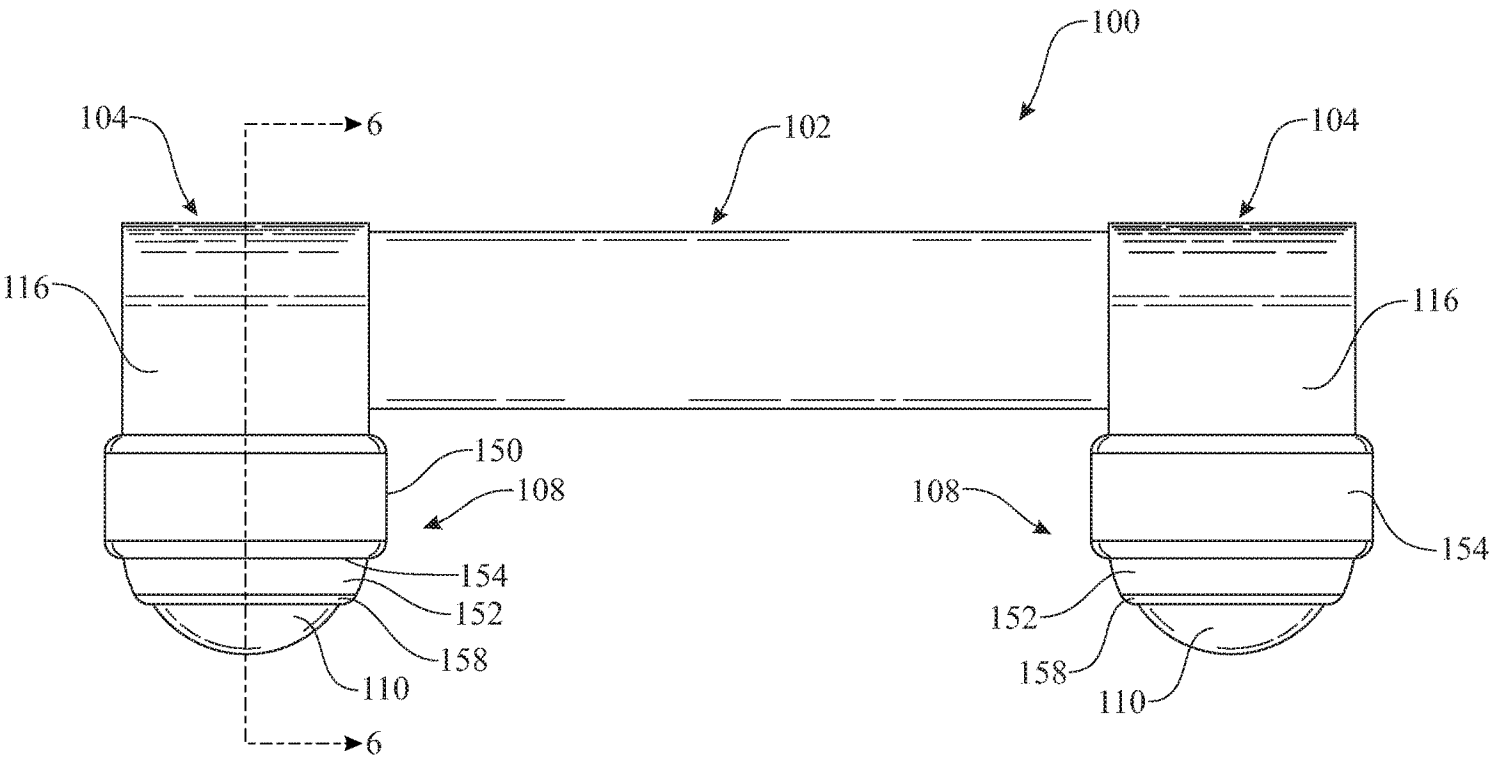
FIG. 4 presents a side elevation view of the device of FIGS. 1 and 2.
Figure 5:
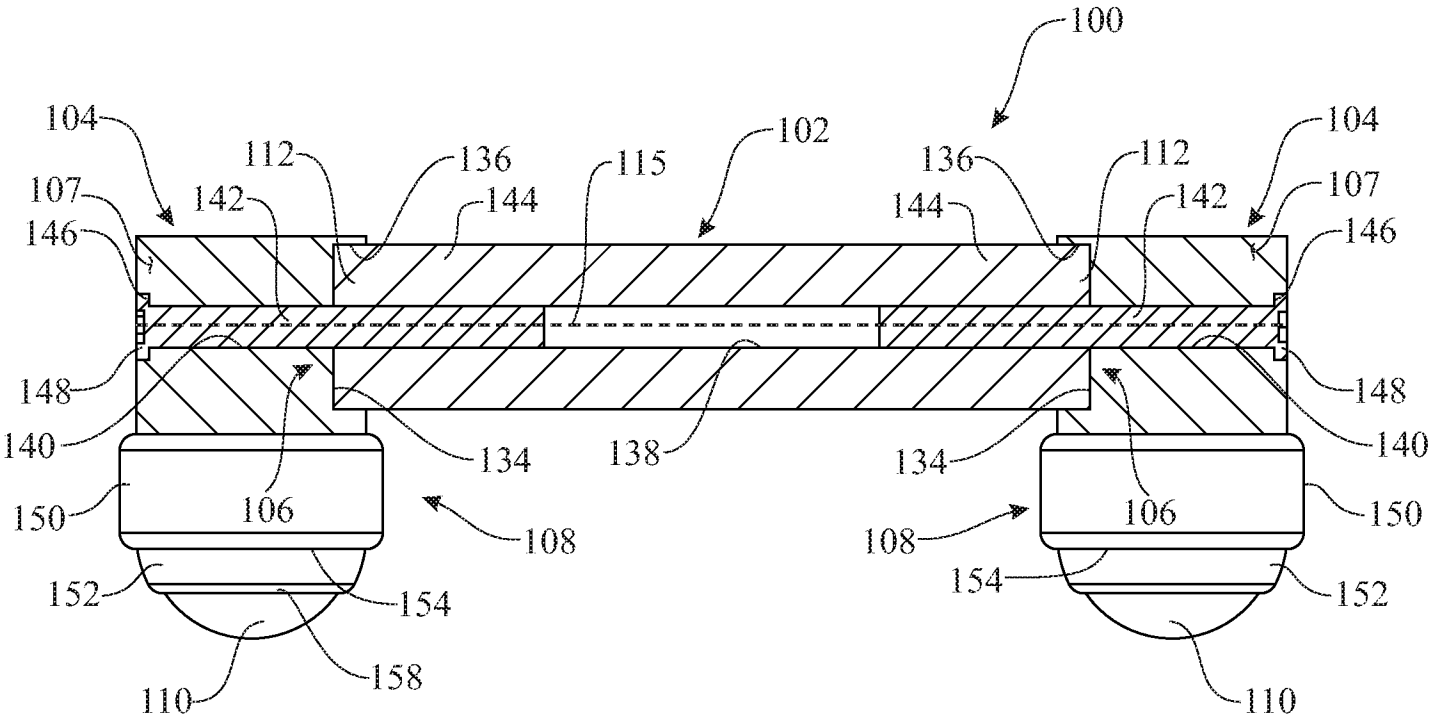
FIG. 5 presents a longitudinal sectional view of the device taken along line 5-5 of FIG. 1, the view showing the device on a slightly reduced scale compared to that of FIG. 1.
Figure 6:
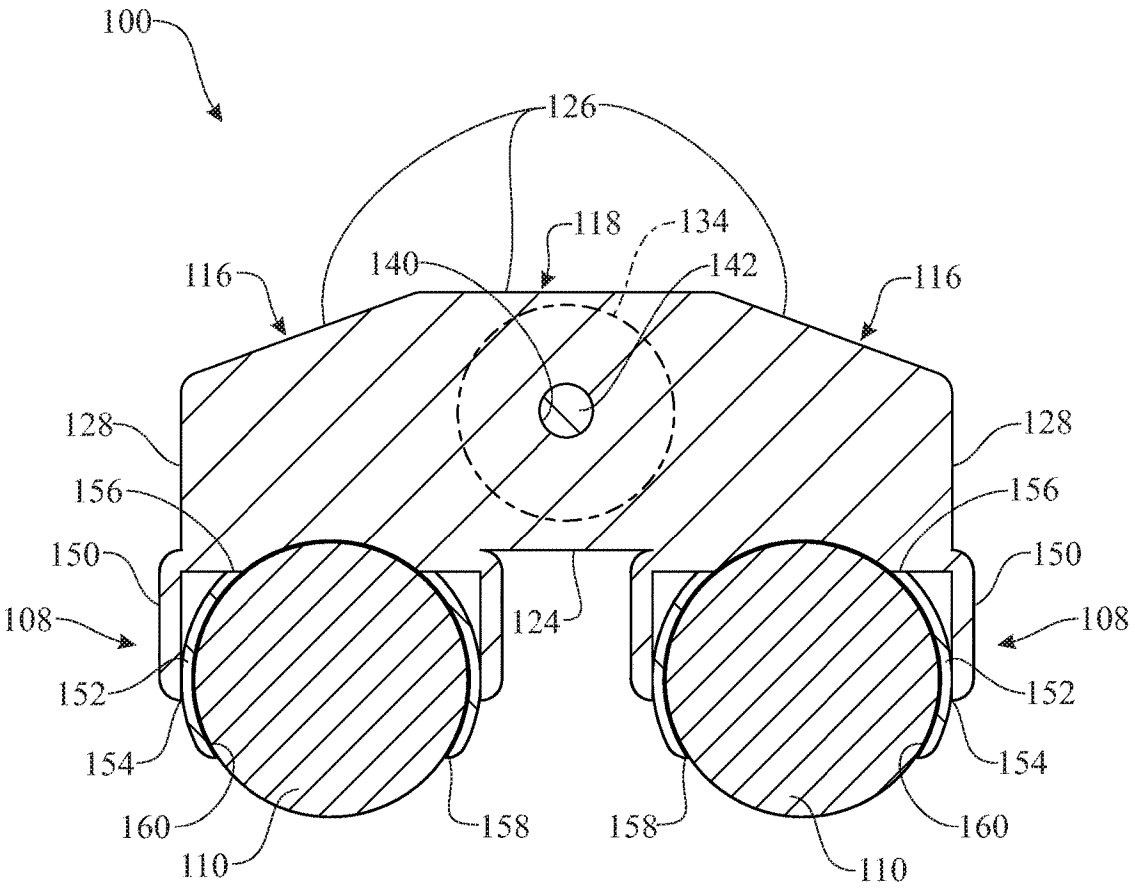
FIG. 6 presents a transverse sectional view of the device taken along line 6-6 of FIG. 4, the view showing the device on an enlarged scale compared to that of FIG. 4.

As best seen in FIGS. 3, 5 and 6, each of the support bodies 104 also has a cavity 134 of a cylindrical configuration and being recessed into the middle portion 118 of each of the support bodies 104 at the inner side 120 thereof to a depth 136 less than the width 130 of the middle portion 118. By way of example, but not of limitation, the depth 136 may be about fifteen percent of the width 130. The cavity 134 is located between and spaced from the bottom and top sides 124, 126 of the support body 104. Being of cylindrical configuration, the cavity 130 is thereby configured to receive one of the opposite ends 112 of the cylindrical handle 102 so as together with the connections 106 provide a snug fitting fixed relationship between the support bodies 104 and the elongated handle 102.

As best seen in FIGS. 3 and 5, the connections 106 that secure the support bodies 104 to the handle 102 in the fixed relationship with respect to each other are provided respectively in and extend between the opposite ends 112 of the handle 102 and the middle portions 118 of the support bodies 104 and in coaxial alignment with the longitudinal axis 115 of the handle so as to retain the support bodies 104 and elongated handle 102 in a secured snug fitting fixed relationship with respect to each other. More particularly, the connections 106 including first bores 138, second bores 140, and threaded fasteners 142. The first bores 138 are respectively threadably formed in at least opposite end portions 144 of the handle 102 so as to extend through the opposite ends 112 of the handle 102 in coaxial alignment with the longitudinal axis 115 thereof. The second bores 140 are respectively formed in the middle portions 118 of the support bodies 102 so as to extend between the recessed cavities 134 and the outer sides 122 of the support bodies 102 and align with the first bores 138 of the handle 102 and in coaxial alignment with the longitudinal axis 115 of the handle. The threaded fasteners 142 are inserted through the second bores 140 of the support bodies 102 and threaded into the first bores 138 of the handle 102 in coaxial alignment with the longitudinal axis 115 of the handle so as to securely connect the handle 102 to the support bodies 104 in a fixed relationship with each other, thereby providing the device 100 with a rigid structural framework.

More specifically, by way of example, but not of limitation, the first bores 138 may be threadably formed completely through the handle 102 from one of the opposite ends 112 to the other of the opposite ends 112. Also, the support bodies 104 have countersunk rims 146 recessed into the outer sides 122 of the support bodies 102 and extending about the second bores 140 such that enlarged heads 148 on the fasteners 142 abut against the countersunk rims 146 when the fasteners 142 are threaded sufficiently into the first bores 138 of the handle 102 to securely connect the handle 102 to the support bodies 104.

As mentioned above and seen in FIGS. 1-6, the mounting seats 108 are provided on and extend below the bottom sides 124 of the beams 107 of the support bodies 104 at their outer end portions 116. For example, there are two mounting seats 108 below the beam 107 of each of the support bodies 104 with each mounting seat 108 being below a respective one of the opposite end portions 116 of the beam 107. More particularly, as best seen in FIGS. 3 and 6, the mounting seats 108 include respective sockets 150 and sleeves 152. Each socket 150 has a hollow cylindrical configuration and a lower open end 154. The sockets 150 may be affixed on and extend below the bottom side 124 of the beam 107 of each of the support bodies 104 at the opposite end portions 116 thereof such that each of the support bodies 104 forms the single unit, as shown in FIG. 6, in which the beam structure 107 and the two mounting seats 108 are integrally formed with one another. Alternatively, the two mounting seats 108 of each of the support bodies 104 may be separate and independent components from the beam 107 of each of the support bodies 104 that are fastened to the beam 107 to form the single unit therewith. Thus, each of the support bodies 104 forms a single unit that is separate and independent from one another such that only the elongated handle 102 extends between and interconnects the two single units.

Each of the sleeves 152 has a spherical configuration with opposite top and bottom truncated ends 156, 158. The sleeves 152 have outside diameters matching the inside diameters of the sockets 150 such that each of the sleeves 152 snugly fits through the lower open end 154 and into a respective one of the sockets 150. The sleeve 152 at its top truncated end 156 is brought into contact with the bottom side 124 of the respective support body 104 at the respective opposite end portion 116 thereof. Furthermore, the bottom side 124 of each of the support bodies 104 at each of the opposite end portions 116 thereof has a concave depression 158 defined thereon being centered relative to one of the sockets 150.

As best seen in FIG. 6, each of the rollers 110 has an outside diameter matching an inside diameter of a respective one of the sleeves 152 such that each roller 110 snugly fits with the one sleeve 152, and with a portion of the roller 110 protruding from the top truncated end 156 of the sleeve 152 also protruding into the respective concave depression 158. The sleeves 152 have substantially frictionless inside surfaces 160 and protrude from the lower open ends 154 of the sockets 152 with the rollers 110 protruding from the bottom truncated ends 158 of the sleeves 152 so as to enable free wheeling rotation of the rollers 110 in the sleeves 152 and in contact with the support surface. In such manner, the support bodies 104 are adapted to be freely rolled by the rollers 110 across the support surface as a user gripping the handle 102 performs exercises and supports a portion of his or her body weight on the handle 102.

Turning now to FIGS. 7-11, there is illustrated another exemplary embodiment of a rolling exercise device, generally designated 200, having a modular construction and a low profile in accordance with the present invention. The rolling exercise device 200 basically includes a support body 202, a plurality of mounting seats 204, and a plurality of rollers 206.

Figure 8:
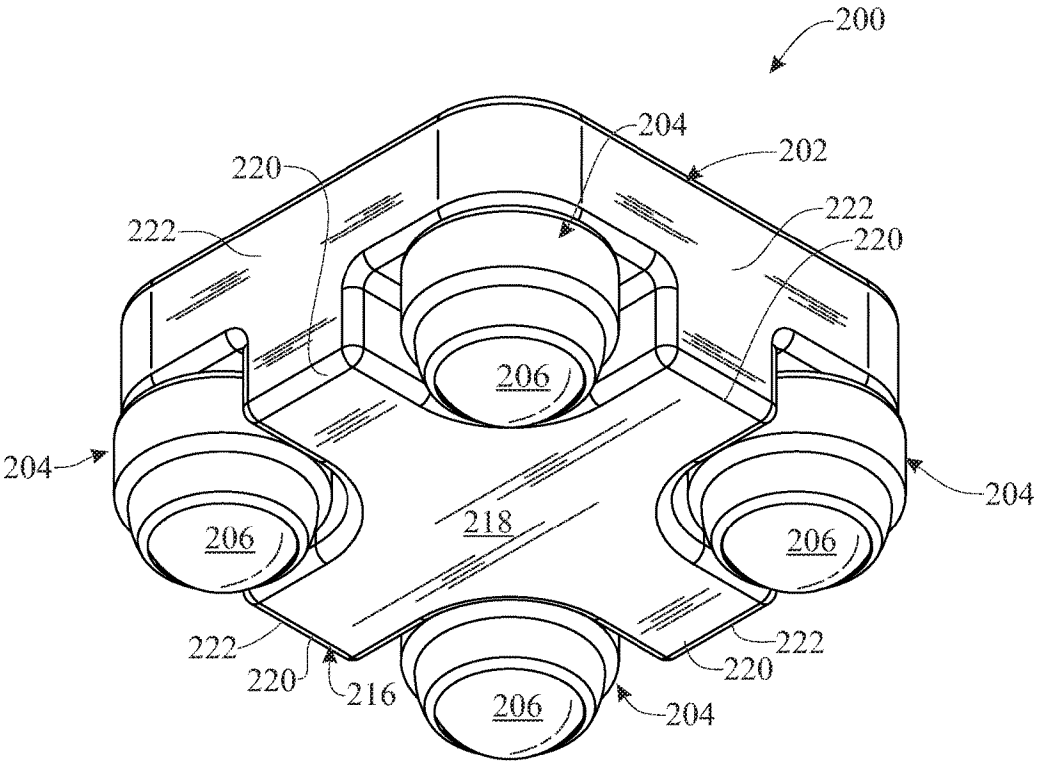
FIG. 8 presents a bottom isometric view of the device originally introduced in FIG. 7.

The support body 202 of the device 200 has a lower body portion 208 and an upper body portion 210. More particularly, the lower body portion 208 of the support body 202 forms at least four recessed corners 212 being spaced apart from one another and having respective recesses 214 open from below and around the exterior of the corners 212. As best seen in FIG. 8, in the exemplary embodiment the lower body portion 208 forms a square cross 216 having a central segment 218 and four radial leg segments 220 terminating at exterior end surfaces 222. The central segment 218 and four radial leg segments 220 form four recessed corners 212 of the lower body portion 208. The respective recesses 214 of the four recessed corners 212 are formed by the central segment 218 and four radial leg segments 220 of the square cross 216.

Figure 7:
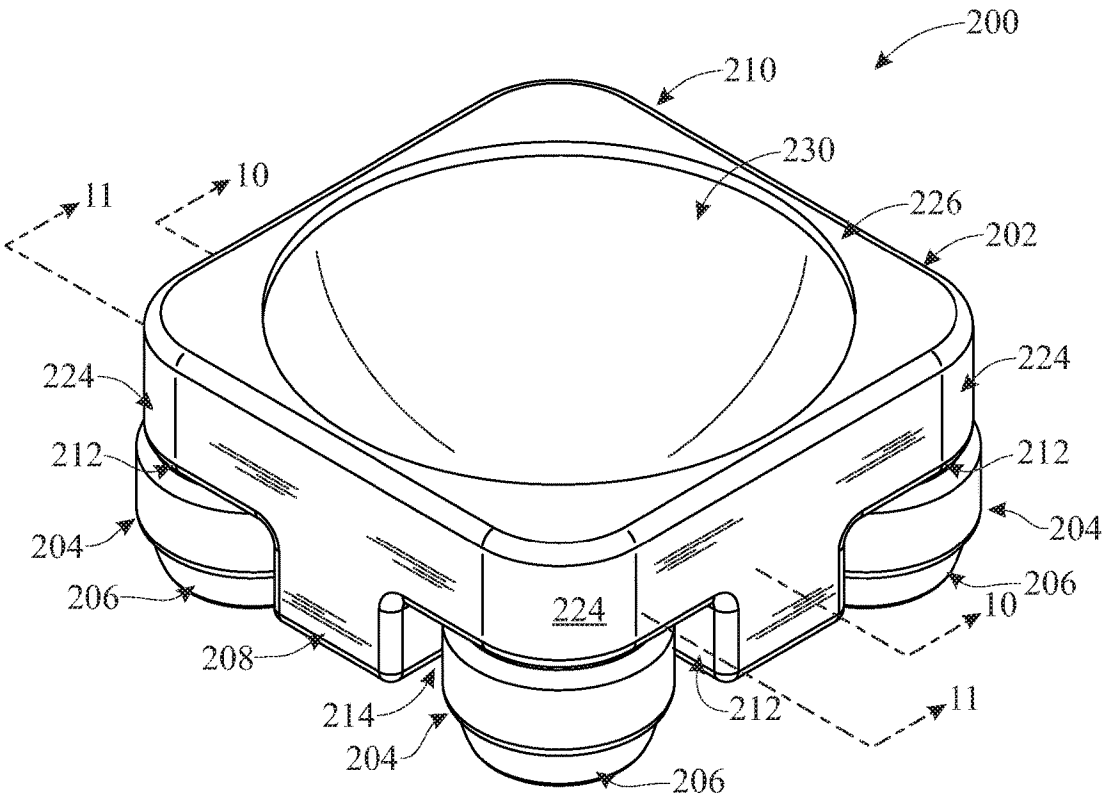
FIG. 7 presents a top isometric view of an exemplary embodiment of a low profile rolling exercise device in accordance with the present invention, the view showing the device in a fully assembled form.

More particularly, the upper body portion 210 of the support body 202 forms at least four solid corner segments 224 being interconnected to one another and overlying the at least four recessed corners 212 of the lower body portion 208. As best seen in FIG. 7, in the exemplary embodiment the upper body portion 210 forms a square platform 226 providing four solid corner segments 224 overlying the four recessed corners 212 of the lower body portion 208. The square platform 226 also provides a continuous exterior sidewall 228 extending about the four solid corner segments 224 and merging with the exterior end surfaces 222 of the four radial leg segments 220 of the lower body portion 208.

Figure 10:
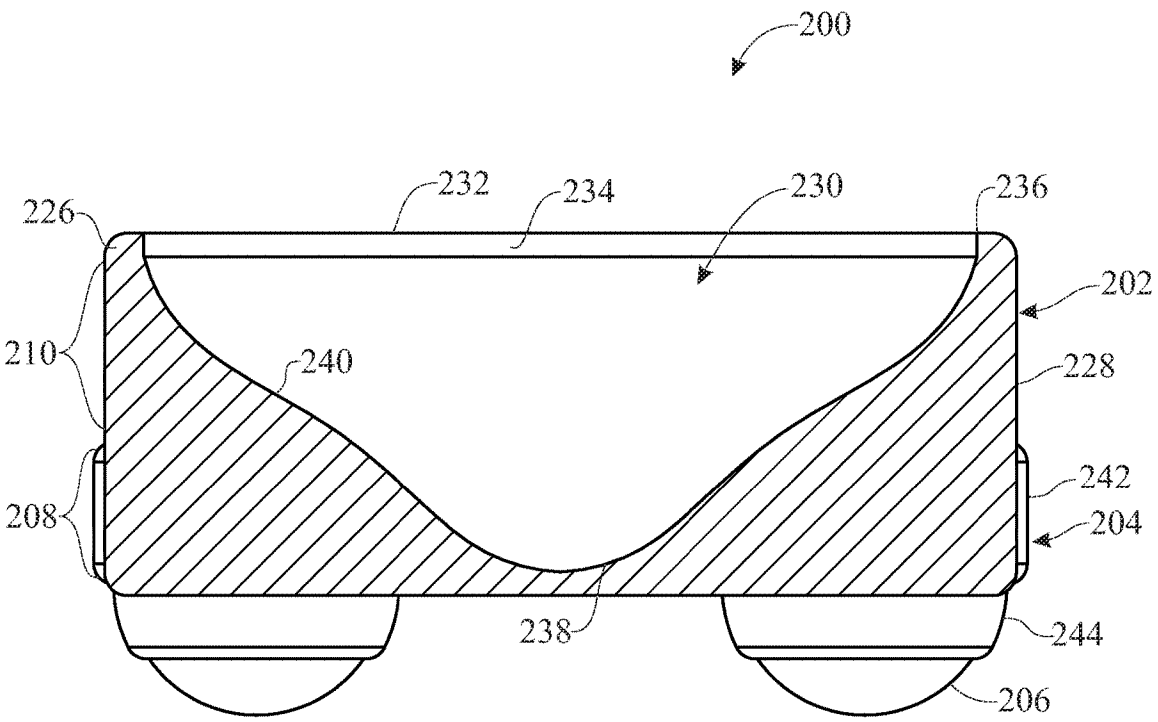
FIG. 10 presents a cross-sectional view of the device taken along section line 10-10 of FIG. 7, the view showing the device on an enlarged scale compared to that of FIG. 7.
Figure 11:
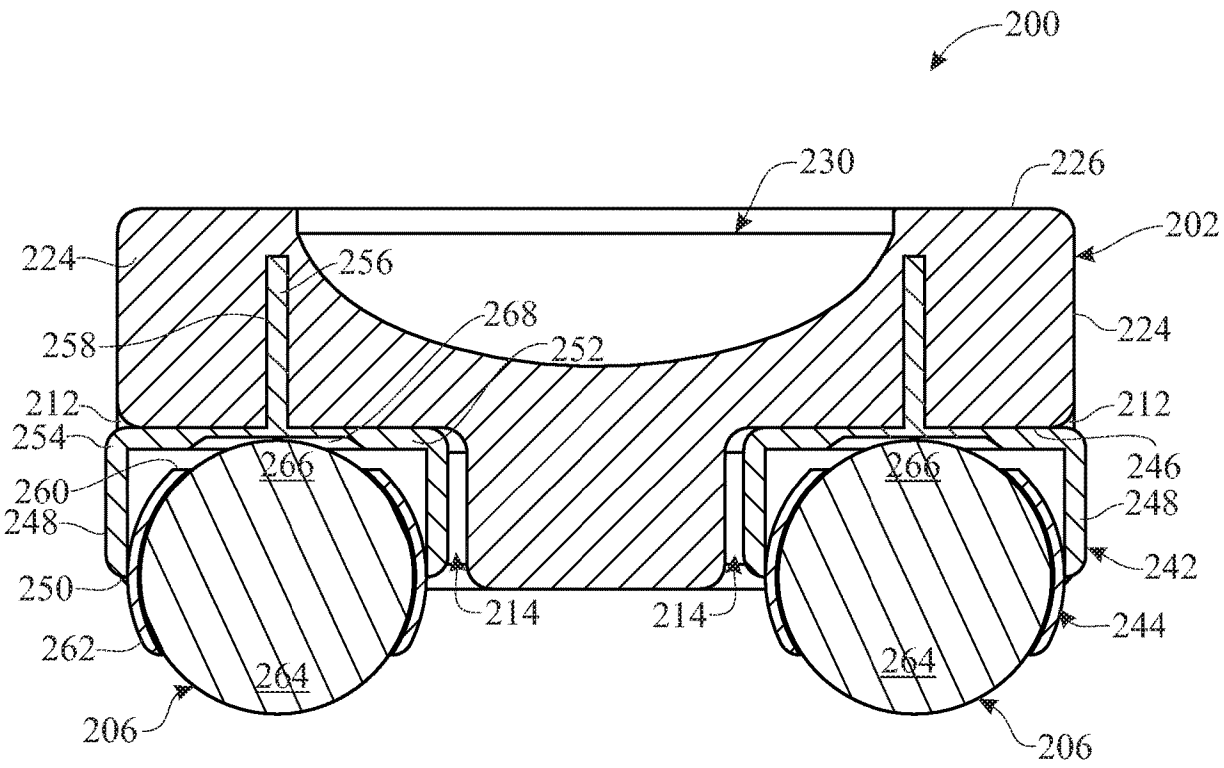
FIG. 11 presents another cross-sectional view of the device taken along section line 11-11 of FIG. 7, the view showing the device on an enlarged scale compared to that of FIG. 7.

As best seen in FIGS. 7, 10 and 11, the support body 202 of the device 200 also has a concave cavity 230 in the lower and upper body portions 208, 210, being recessed from the upper body portion 210 into the lower body portion 208. More particularly, the concave cavity 230 has a top opening 232 in the upper body portion 210, being defined by a continuous interior top surface 234 on or proximate to a continuous interior rim 236 of the upper body portion 210, an interior concave bottom wall surface 238 in the lower body portion 208, and a continuous interior sidewall surface 240 in the upper and lower body portions 210, 208 that interconnects the continuous interior top surface 234 and the interior concave bottom wall surface 238. The concave cavity 230 has a depth extending from the top opening 232 to the concave bottom wall surface 238 which is at a maximum at a central location of the cavity 230 in the upper and lower body portions 210, 208 of the support body 202.

Figure 9:
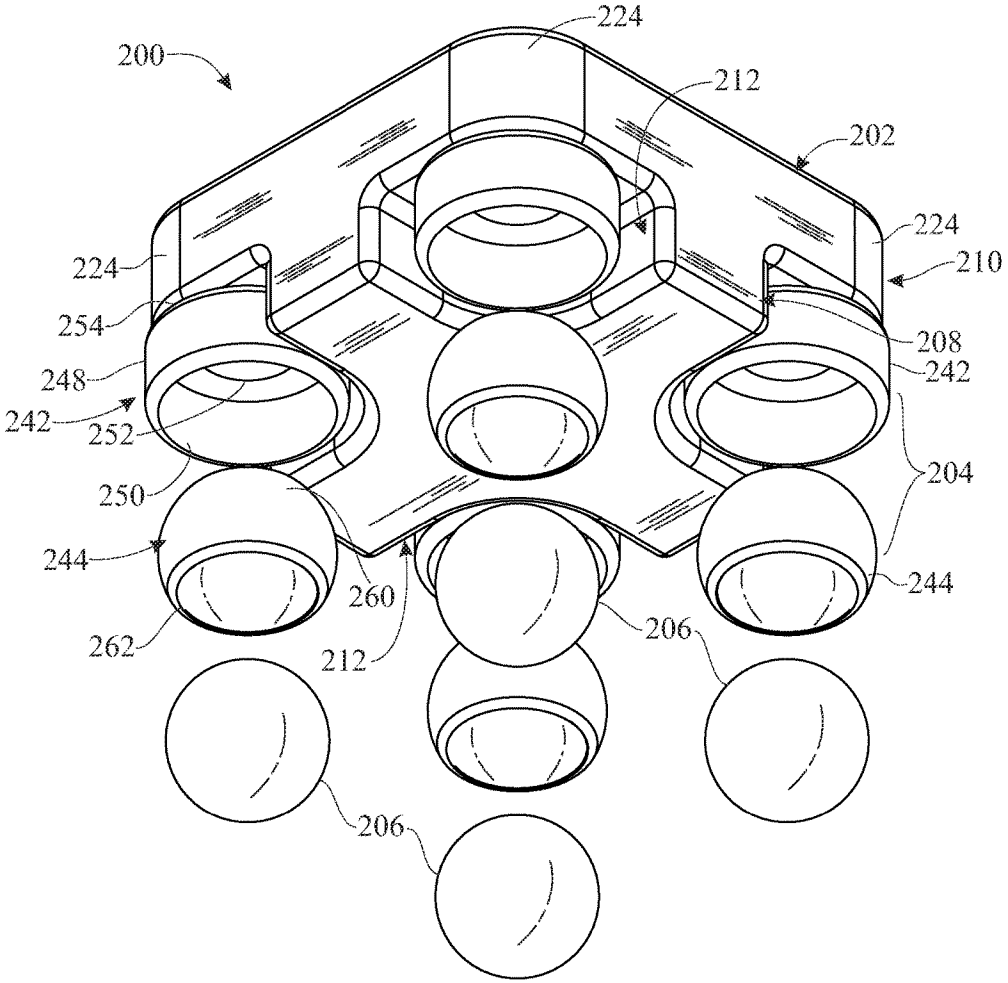
FIG. 9 presents a top isometric view of the device, the view showing the device of FIGS. 7 and 8 in an exploded form.

As best seen in FIGS. 8, 9 and 11, each of the mounting seats 204 of the device 200 is supported in a respective one of the four recessed corners 212 of the lower body portion 208 of the support body 202. The mounting seats 204 are interchangeable with one another with respect to their relationships to the corners 212 of the lower body portion 208. Each mounting seat 204 includes a socket 242 and a sleeve 244.

More particularly, each socket 242 of a respective mounting seat 204 is affixed on and extends below a bottom side 246 of a respective one of the four corner segments 224 of the upper body portion 210 of the support body 202. Each socket 242 is of a hollow configuration and has a cylindrical sidewall 248 with a lower open end 250 and an upper wall 252 extending across and affixed to an upper end 254 of the cylindrical sidewall 248. Each socket 242 has an upstanding tab 256 affixed to and extending upwardly from the upper wall 252 and snugly fitted into a corresponding slot 258 defined in a respective one of the four corner segments 224 of the upper body portion 210 overlying the four recessed corners 212 of the lower body portion 208.

Each sleeve 244 of a respective mounting seat 204 has a spherical configuration with opposite top and bottom truncated ends 260, 262. Each sleeve 244 has an outside diameter matched with an inside diameter of a respective one of the sockets 242 such that each sleeve snugly fits through the lower open end 250 and into the respective one socket 242. Also, each sleeve 242 at the top truncated end 260 is spaced below the upper wall 252 of the respective one socket 242. Further, each sleeve 242 at an end portion adjacent to the bottom truncated end 262 thereof respectively protrudes downward from the lower open end 250 of the cylindrical sidewall 248 of the respective one socket 242.

Each roller 206 is rotatably mounted in a respective one of the sleeves 244 of a respective mounting seat 204 and extending below the square cross 216 of the lower body portion 208 of the support body 202 so as to adapt the support body to be freely rolled by the rollers 206 across a surface supporting the rolling exercise device 200 with at least a portion of a foot of a user extending into the concave cavity 230 of the support body 202 to support at least a portion of the body weight of the user on the rolling exercise device 200 as the user performs exercises on the surface. A lower portion 264 of each roller 206 protrudes from and to below the bottom truncated end 262 of a respective one of the sleeves 242. An upper portion 266 of each roller 206 protrudes from and to above the top truncated end 260 of the respective one sleeve 242 and into a depression 268 in the upper wall 252 of the respective one socket 242. Each sleeve 242 has a substantially frictionless inside surface 270 so as to enable free-wheeling rotation of the rollers 206 in the sleeves 242 and in contact with the support surface.

In summary, the above-described components of the rolling exercise devices 100, 200 provide each of them with a modular construction and a low profile that reduces its overall height and weight, facilitates its ease of manufacture and assembly, and augments its structural integrity during use.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A rolling exercise device, comprising:

a support body comprising a lower body portion forming at least four recessed corners spaced apart from one another and having respective recesses open from below and around an exterior of said at least four recessed corners, an upper body portion forming at least four corner segments interconnected to one another and overlying said at least four recessed corners of said lower body portion, and a cavity recessed in said upper and lower body portions and extending from a top opening defined by a continuous interior rim of said upper body portion to and including an interior concave bottom wall surface of said lower body portion;

a plurality of mounting seats each being supported in a respective one of said recesses of said at least four recessed corners of said lower body portion of said support body; and a plurality of rollers each being rotatably mounted in a respective one of said plurality of mounting seats and extending below said lower body portion of said support body so as to adapt said support body to be freely rolled by said plurality of rollers across a surface supporting said rolling exercise device with at least a portion of a foot of a user extending into said cavity of said support body to support at least a portion of the body weight of the user on said rolling exercise device as the user performs exercises on the surface.

2. The rolling exercise device of claim 1 wherein said lower body portion of said support body provides a central segment and at least four radial leg segments.

3. The rolling exercise device of claim 2 wherein said respective recesses of said at least four recessed corners are formed by said central segment and said at least four radial leg segments.

4. The rolling exercise device of claim 3 wherein said at least four radial leg segments terminate at exterior end surfaces.

5. The rolling exercise device of claim 4 wherein said upper body portion further comprises a continuous exterior sidewall extending about said at least four corner segments and merging with said exterior end surfaces of said at least four radial leg segments of said lower body portion.

6. The rolling exercise device of claim 1 wherein said cavity has a depth extending from said top opening to said concave bottom wall surface where said depth is at a maximum at a central location of said cavity in said upper and lower body portions of said support body.

7. The rolling exercise device of claim 1 wherein said cavity further comprises a continuous interior sidewall extending in said upper and lower body portions so as to interconnect said continuous interior rim of said upper body portion and said concave bottom wall surface of said lower body portion.

8. The rolling exercise device of claim 1 wherein each of said plurality of mounting seats are interchangeable with one another.

9. A rolling exercise device, comprising:

a support body comprising a lower body portion forming a square cross having a central segment and four radial leg segments terminating at exterior end surfaces, and four recessed corners spaced apart from one another and having respective recesses formed by said central segment and said four radial leg segments of said square cross and being open from below and around an exterior of said four recessed corners, an upper body portion forming a square platform having four corner segments interconnected to one another and overlying said four recessed corners of said lower body portion, and a continuous exterior sidewall extending about said four corner segments and merging with said exterior end surfaces of said four radial leg segments of said lower body portion, and a concave cavity formed in said upper and lower body portions and having a top opening defined by a continuous interior top surface proximate a continuous interior rim of said square platform of said upper body portion, an interior concave bottom wall surface defined in said central segment of said square cross of said lower body portion, and a continuous interior sidewall surface extending in said upper and lower body portions so as to interconnect said continuous interior rim of said upper body portion and said interior concave bottom wall surface of said lower body portion;

a plurality of mounting seats each being disposed in a respective one of said recesses of said four recessed corners of said lower body portion of said support body; and a plurality of rollers each being rotatably mounted in a respective one of said plurality of mounting seats and extending below said square cross of said lower body portion of said support body so as to adapt said support body to be freely rolled by said plurality of rollers across a surface supporting said rolling exercise device with at least a portion of a foot of a user extending into said cavity of said support body to support at least a portion of the body weight of the user on said rolling exercise device as the user performs exercises on the surface.

10. The rolling exercise device of claim 9 wherein each of said plurality of mounting seats comprises:

a socket affixed on and extending below a bottom side of a respective one of said four corner segments of said upper body portion of said support body, said socket being of a hollow configuration and having a cylindrical sidewall with a lower open end and an upper wall across and affixed to an upper end of said cylindrical sidewall; and a sleeve of a spherical configurations with opposite top and bottom truncated ends, said sleeve having an outside diameter matched with an inside diameter of said cylindrical sidewall of said socket such that said sleeve snugly fits, via said lower open end of said socket, into said socket, said sleeves having inside diameters match with outside diameters of said plurality of rollers such that each roller of the plurality of rollers snugly fits with one of said sleeves.

11. The rolling exercise device of claim 10 wherein each of said sleeves at an end portion adjacent said bottom truncated end thereof respectively protrudes from said lower open end of said cylindrical sidewall of a respective one of said sockets with a portion of a respective one of said plurality of rollers protruding from and below said bottom truncated end of each of said sleeve.

12. The rolling exercise device of claim 10 wherein each of said sleeves at said top truncated end is spaced below said upper wall of a respective one of said sockets.

13. The rolling exercise device of claim 10 wherein each of said sockets has an upstanding tab affixed to and extending upwardly from said upper wall of said socket and snugly fitted into a corresponding slot defined in a respective one of said four corner segments of said upper portion overlying said four recessed corners of said lower body portion of said support body.

14. The rolling exercise device of claim 9 wherein each of said plurality of mounting seats are interchangeable with one another.

15. A rolling exercise device, comprising:

a support body comprising a lower body portion forming a square cross having a central segment and four radial leg segments terminating at exterior end surfaces, and four recessed corners having respective recesses formed by said central segment and four radial leg segments of said square cross and being open from below and around an exterior of said four recessed corners, an upper body portion forming a square platform having four corner segments interconnected to one another and overlying said four recessed corners of said lower body portion, and a continuous exterior sidewall extending about said four corner segments and merging with said exterior end surfaces of said four radial leg segments of said lower body portion, and a concave cavity formed in said upper and lower body portions and having a top opening defined by a continuous interior top surface proximate a continuous interior rim of said square platform of said upper body portion, an interior concave bottom wall surface defined in said central segment of said square cross of said lower body portion, and a continuous interior sidewall surface extending between said upper and lower body portions so as to interconnect said continuous interior top surface of said upper body portion and said interior concave bottom wall surface of said lower body portion;

a plurality of mounting seats each being supported in a respective one of said recesses of said four recessed corners of said lower body portion of said support body, each of said plurality of mounting seats comprising a socket affixed to and extending below a bottom side of a respective one of said four corner segments of said upper body portion of said support body, said socket of a hollow configuration and having a cylindrical sidewall with a lower open end and an upper wall across and affixed to an upper end of said cylindrical sidewall, and a sleeve of a spherical configuration with opposite top and bottom truncated ends, said sleeve having an outside diameter matched with an inside diameter of said cylindrical sidewall of said socket such that said sleeve snugly fits, via said lower open end of said socket, into said socket; and a plurality of rollers each being rotatably mounted in a respective one of said sleeves of said plurality of mounting seats and extending above and below said top and bottom truncated ends of said respective one of said sleeves and below said square cross of said lower body portion of said support body so as to adapt said support body to be freely rolled by said plurality of rollers across a surface supporting said rolling exercise device with at least a portion of a foot of a user extending into said cavity of said support body to support at least a portion of the body weight of the user on said rolling exercise device as the user performs exercises on the surface.

16. The rolling exercise device of claim 15 wherein said plurality of rollers each having an outside diameter matching an inside diameter of one of said sleeves such that each roller of the plurality of rollers snugly fits with one of said sleeves.

17. The rolling exercise device of claim 15 wherein a portion of one of said plurality of rollers protruding from said top truncated end of said sleeve protrudes into a respective depression in said upper wall of said socket.

18. The rolling exercise device of claim 15 wherein each of said sleeves has substantially frictionless inside surface so as to enable free-wheeling rotation of said plurality of rollers in said sleeves and in contact with said support surface.

19. The rolling exercise device of claim 15 wherein each of said sockets has an upstanding tab affixed to and extending upwardly from said upper wall of said socket and snugly fitted into a corresponding slot defined in a respective one of said four corner segments of said upper portion overlying said four recessed corners of said lower body portion of said support body.

20. The rolling exercise device of claim 15 wherein each of said plurality of mounting seats are interchangeable with one another.

* * * * *